US011238796B2

(12) United States Patent
Han et al.

(10) Patent No.: US 11,238,796 B2
(45) Date of Patent: Feb. 1, 2022

(54) PIXEL CIRCUIT AND CONTROL METHOD THEREFOR, DISPLAY SUBSTRATE AND DISPLAY DEVICE

(71) Applicant: BOE TECHNOLOGY GROUP CO., LTD., Beijing (CN)

(72) Inventors: Seungwoo Han, Beijing (CN); Guangliang Shang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 200 days.

(21) Appl. No.: 16/334,539

(22) PCT Filed: Jun. 13, 2018

(86) PCT No.: PCT/CN2018/091099

§ 371 (c)(1),
(2) Date: Mar. 19, 2019

(87) PCT Pub. No.: WO2019/056813

PCT Pub. Date: Mar. 28, 2019

(65) Prior Publication Data

US 2020/0388218 A1 Dec. 10, 2020

(30) Foreign Application Priority Data

Sep. 22, 2017 (CN) ..... 201710866018.3

(51) Int. Cl.
*G09G 3/3258* (2016.01)

(52) U.S. Cl.
CPC ... *G09G 3/3258* (2013.01); *G09G 2300/0842* (2013.01); *G09G 2320/043* (2013.01); *G09G 2330/02* (2013.01)

(58) Field of Classification Search
CPC ..... G09G 3/3258; G09G 2330/02; G09G 2300/0842; G09G 2320/043
See application file for complete search history.

(56) References Cited

U.S. PATENT DOCUMENTS

| | | | | |
|---|---|---|---|---|
| 10,056,032 | B2 * | 8/2018 | Kwon | G09G 3/3275 |
| 2008/0191976 | A1 * | 8/2008 | Nathan | G09G 3/3291 345/76 |
| 2015/0154899 | A1 * | 6/2015 | Chang | G09G 3/3648 345/76 |

FOREIGN PATENT DOCUMENTS

| | | | |
|---|---|---|---|
| CN | 106328062 | A | 1/2017 |
| CN | 106652911 | A | 5/2017 |

(Continued)

OTHER PUBLICATIONS

International Search Report and Written Opinion for International Appl. No. PCT/CN2018/091099, dated Sep. 10, 2018.

*Primary Examiner* — Stephen G Sherman
(74) *Attorney, Agent, or Firm* — The Webb Law Firm

(57) ABSTRACT

This disclosure discloses a pixel circuit and a control method therefor, a display substrate and a display device. The pixel circuit comprises a first transistor, a second transistor, a third transistor, a storage capacitor and a light-emitting element. The pixel circuit further comprises a first sensing circuit and a second sensing circuit, wherein the first sensing circuit is connected in parallel with the first transistor, and the second sensing circuit is connected in parallel with the second transistor; a first sensing signal and a second sensing signal are respectively input to the first sensing circuit and the second sensing circuit for completing acquisition of electrical parameters of the pixel circuit according to the first sensing signal and the second sensing signal.

18 Claims, 9 Drawing Sheets

(56) References Cited

FOREIGN PATENT DOCUMENTS

| | | | |
|---|---|---|---|
| CN | 107622754 | A | 1/2018 |
| CN | 207217081 | U | 4/2018 |
| KR | 20170006350 | A | 1/2017 |
| KR | 20170080331 | A | 7/2017 |

* cited by examiner

PIXEL CIRCUIT AND CONTROL METHOD THEREFOR, DISPLAY SUBSTRATE AND DISPLAY DEVICE

CROSS-REFERENCE TO RELATED APPLICATIONS

This application is a U.S. National Stage Application under 35 U.S.C. § 371 of International Patent Application No. PCT/CN2018/091099 filed on Jun. 13, 2018, which claims priority to Chinese Patent Application No. 201710866018.3 filed on Sep. 22, 2017, both of which are hereby incorporated by reference in entirety into this application for all purposes.

TECHNICAL FIELD

This disclosure relates to a pixel circuit and a control method therefor, a display substrate and a display device.

BACKGROUND

An OLED (Organic Light Emitting Diode) display device is a kind of display device with organic luminescent materials emitting light when carrier injection and recombination occur therein under the drive of an electric field, and has advantages such as self-luminescence, wide angle of view, high contrast, lower power consumption, and extremely high response speed.

In related technologies, driving signals of the OLED display device comprise two control signals GateA and GateB, and normal scanning drive is carried out in a scanning (Scan) interval, while threshold voltage (Vth) compensation and K-value compensation are carried out in a blanking (V-blanking) interval.

There is a need to improve the threshold voltage (Vth) compensation and the K-value compensation.

SUMMARY

This disclosure proposes a pixel circuit and a control method therefor, a display substrate and a display device.

According to a first aspect of embodiments of this disclosure, a pixel circuit is provided, comprising a first transistor, a second transistor, a third transistor, a storage capacitor and a light-emitting element; wherein a control electrode of the first transistor is connected to a first scanning line, first and second electrodes of the first transistor are respectively connected to a data line and a control electrode of the third transistor, a control electrode of the second transistor is connected to a second scanning line, first and second electrodes of the second transistor are respectively connected to a second electrode of the third transistor and a sensing line, a first electrode of the third transistor is connected to a first power supply terminal, first and second ends of the storage capacitor are respectively connected to the control electrode of the third transistor and the first electrode of the second transistor, and first and second electrodes of the light-emitting element are respectively connected to the second electrode of the third transistor and a second power supply terminal.

The pixel circuit further comprises a first sensing circuit and a second sensing circuit, wherein the first sensing circuit is connected in parallel with the first transistor, and the second sensing circuit is connected in parallel with the second transistor; a first sensing signal and a second sensing signal are respectively input to the first sensing circuit and the second sensing circuit for completing acquisition of electrical parameters of the pixel circuit according to the first sensing signal and the second sensing signal.

In one example, the first sensing circuit comprises a fourth transistor, wherein the first sensing signal is input to a control electrode of the fourth transistor, and first and second electrodes of the fourth transistor are respectively connected to the data line and the control electrode of the third transistor.

In one example, the second sensing circuit comprises a fifth transistor, wherein the second sensing signal is input to a control electrode of the fifth transistor, and first and second electrodes of the fifth transistor are respectively connected to the second electrode of the third transistor and the sensing line.

In one example, same driving signals are input to the first scanning line and the second scanning line.

In one example, the third transistor is a driving transistor.

In one example, the light-emitting element is an organic light-emitting diode.

According to a second aspect of the embodiments of this disclosure, a method for controlling the pixel circuit as recited in any of the preceding items is provided, comprising:

during a driving phase, connecting both the first scanning line and the second scanning line to a high level, thereby the first transistor and the second transistor are switched on, and a drive current is generated according to a data line signal input to the control electrode of the third transistor and a first supply voltage input to the first electrode of the third transistor, to drive the light-emitting element to emit light;

during a compensation phase, setting both the first sensing signal and the second sensing signal to a high level, thereby both the first sensing circuit and the second sensing circuit are switched on, wherein:

in a first period of the compensation phase, the data line signal is input to the control electrode of the third transistor via the first sensing circuit, and a low level reference voltage signal on the sensing line is input to the second electrode of the third transistor via the second sensing circuit;

in a second period of the compensation phase, the data line signal is input to the control electrode of the third transistor via the first sensing circuit, and the second electrode of the third transistor is continuously charged to a first voltage;

in a third period of the compensation phase, the second electrode of the second transistor is charged to the first voltage of the second electrode of the third transistor via the second sensing circuit;

in a fourth period of the compensation phase, the first voltage of the second electrode of the second transistor is output via the sensing line to an external circuit, to complete the acquisition of the electrical parameters of the pixel circuit.

In one example, a control timing of the pixel circuit includes a normal drive timing and a blanking region of the pixel circuit, and the driving phase is in the normal drive timing, and the compensation phase is in the blanking region.

In one example, the method is applied to threshold voltage compensation, and the first voltage is a data line signal voltage minus a threshold voltage of the third transistor.

According to a third aspect of the embodiments of this disclosure, a method for controlling the pixel circuit as recited in any of the preceding items is provided, comprising:

during a driving phase, connecting the first scanning line and the second scanning line to a high level, thereby the first transistor and the second transistor are switched on, and a drive current is generated according to a data line signal input to the control electrode of the third transistor and a first supply voltage input to the first electrode of the third transistor, to drive the light-emitting element to emit light;

in a first period of a compensation phase, setting both the first sensing signal and the second sensing signal to a high level, both the first sensing circuit and the second sensing circuit are switched on, the data line signal is input to the control electrode of the third transistor via the first sensing circuit, and a low level reference voltage signal on the sensing line is input to the second electrode of the third transistor via the second sensing circuit;

in a second period of the compensation phase, setting the first sensing signal to a low level, setting the second sensing signal to a high level, thereby the first sensing circuit is switched off, the second sensing circuit is switched on, charging of the storage capacitor is completed and both ends of the storage capacitor are floating, the second electrode of the third transistor is charged to a data line signal voltage, and the control electrode of the third transistor is coupled to a second voltage;

in a third period of the compensation phase, setting the first sensing signal to a low level, setting the second sensing signal to a high level, thereby the first sensing circuit is switched off, the second sensing circuit is switched on, and the second electrode of the second transistor is charged to the data line signal voltage of the second electrode of the third transistor via the second sensing circuit;

in a fourth period of the compensation phase, setting both the first sensing signal and the second sensing signal to a high level, thereby both the first sensing circuit and the second sensing circuit are switched on, and the data line signal voltage of the second electrode of the second transistor is output via the sensing line to an external circuit, to complete the acquisition of the electrical parameters of the pixel circuit.

In one example, a control timing of the pixel circuit includes a normal drive timing and a blanking region of the pixel circuit, and the driving phase is in the normal drive timing, and the compensation phase is in the blanking region.

In one example, the method is applied to carrier mobility compensation, and the second voltage is the data line signal voltage plus a threshold voltage of the third transistor.

According to a fourth aspect of the embodiments of this disclosure, a display substrate is provided, comprising the pixel circuit as recited in any of the preceding items.

According to a fifth aspect of the embodiments of this disclosure, a display device is provided, comprising the display substrate as recited above.

DETAILED DESCRIPTION

To make the objectives, technical solutions and advantages of this disclosure clearer, this disclosure is further described in detail in the following in combination with specific embodiments with reference to the accompanying drawings.

It should be noted that, all expressions using "first" and "second" in the embodiments of this disclosure are intended to make a distinction between two different entities or two different parameters with a same name. It follows that, "first", "second" are only used for the sake of expression, and shall not be construed as restrictions to the embodiments of this disclosure, which is not repeated in subsequent embodiments.

In general, a pixel drive circuit of an AMOLED (Active Matrix Organic Light-Emitting Diode) display device is provided with a driving thin film transistor for driving the organic light-emitting diode to emit light. In the use of the AMOLED, aging of the organic light-emitting diode and an offset of a threshold voltage of the driving thin film transistor will result in the deterioration of the display quality of the OLED display device, so the related technologies will compensate for the threshold voltage of the driving thin film transistor in the use of the OLED display device, wherein the current flowing through the organic light-emitting diode is represented by the following equation:

$$I_{ds}=(1/2)\mu_n C_{ox}(W/L)(V_{gs}-V_{th})^2$$

where $I_{ds}$ is the current flowing through the organic light-emitting diode, $\mu_n$ is a carrier mobility of the driving thin film transistor, $C_{ox}$ is a circuit-area capacitance of a gate oxidization layer of the driving thin film transistor, W/L is a channel width to length ratio of the driving thin film transistor, $V_{gs}$ is a gate-source voltage of the driving thin film transistor, $V_{th}$ is a threshold voltage of the driving thin film transistor; a value of $\mu_n C_{ox}$ (W/L) is called a K-value of the driving thin film transistor, the K-value will also drift during the use of the OLED display substrate, and the drift of the K-value will also affect the performance of the driving thin film transistor, thereby deteriorating the display quality of the OLED display device. Therefore, in addition to the compensation for the threshold voltage during the use of the OLED display device, it is also needed to sense and compensate the K-value of the driving thin film transistor, to guarantee the display quality during the use of the OLED display device.

Figure 1A:
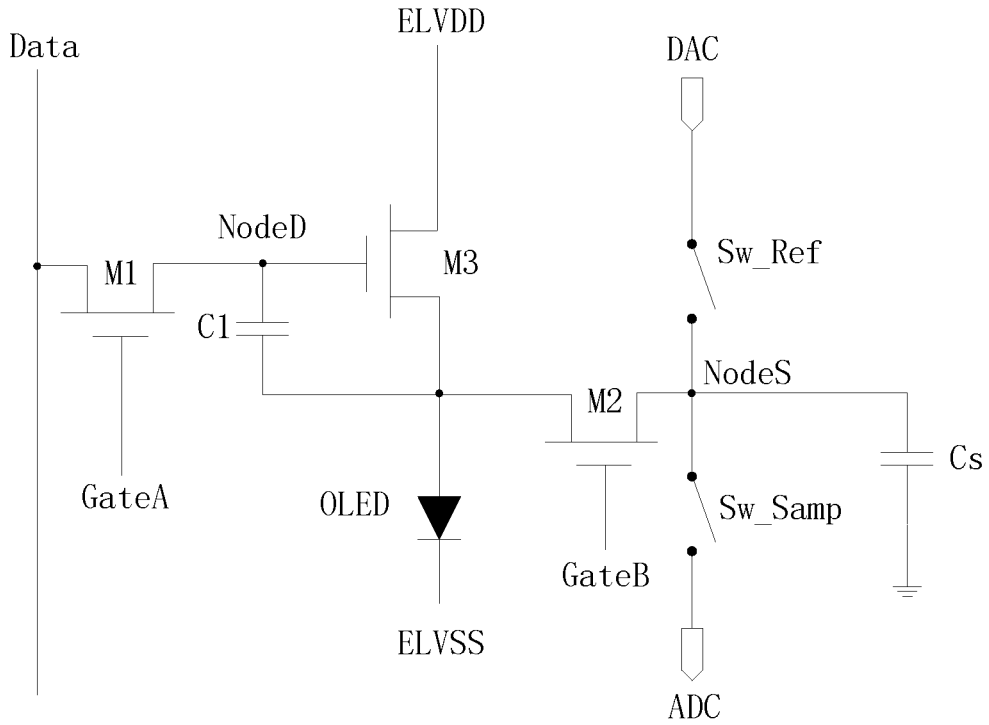
FIG. 1*a* is a schematic diagram showing a circuit structure of an OLED pixel circuit in the related technologies.

FIG. 1*a* is a schematic diagram showing a circuit structure of an OLED pixel circuit in the related technologies.

The pixel circuit comprises a first transistor M1, a second transistor M2, a third transistor M3, a storage capacitor C1 and a light-emitting element OLED. A control electrode of the first transistor M1 is connected to a first control line GateA, first and second electrodes of the first transistor M1 are respectively connected to a data line Data and the third transistor M3's control electrode, a control electrode of the second transistor M2 is connected to a second control line GateB, first and second electrodes of the second transistor M2 are respectively connected to a second electrode of the third transistor M3 and a sensing line, a first end of the sensing line is connected to a DAC circuit via a first switch Sw_Ref for inputting a reference voltage, and a second end of the sensing line is connected to an ADC circuit via a second switch Sw_Samp for acquiring corresponding electrical parameters to complete parameter compensation; a first electrode of the third transistor M3 is connected to a first power supply terminal ELVDD, first and second ends of the storage capacitor C1 are respectively connected to the control electrode of the third transistor M3 and the first electrode of the second transistor M2, and first and second electrodes of the light-emitting element OLED are respectively connected to the second electrode of the third transistor M3 and a second power supply terminal ELVSS, and the sensing line is connected in parallel with a sensing line capacitor Cs.

Figure 1B:
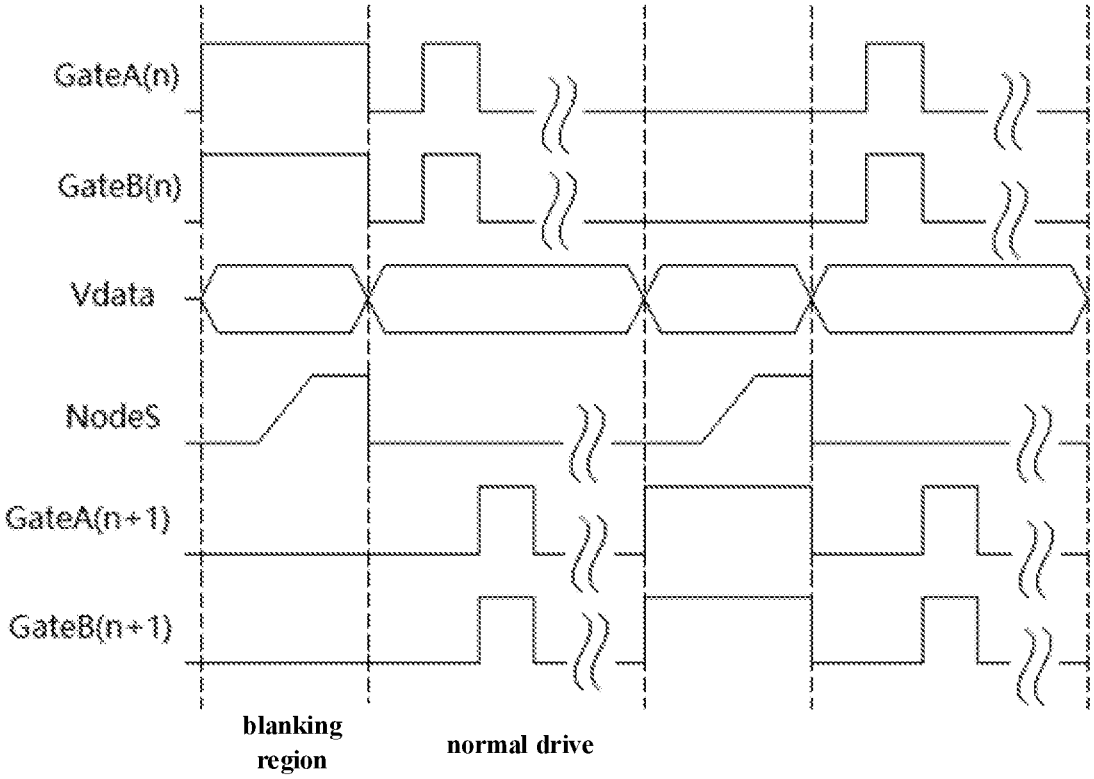
FIG. 1*b* is a schematic diagram showing a drive timing of the OLED pixel circuit in the related technologies during threshold voltage sensing.

FIG. 1*b* is a schematic diagram showing a drive timing of the OLED pixel circuit in the related technologies during threshold voltage sensing (Vth sensing).

The process of the threshold voltage sensing and the threshold voltage compensation in the related technologies is briefly introduced below in combination with FIG. 1*a* and FIG. 1*b*.

The OLED pixel circuit in the related technologies completes the normal drive of the OLED in the normal driving phase, and realizes the threshold voltage (Vth) sensing in the blanking region (Blanking) phase. For the nth pixel circuit, the operations performed in the blanking region are as follows. The control signal GateA (referring to GateA(n) in FIG. 1*b*) and the control signal GateB (referring to GateB(n) in FIG. 1*b*) are in a high level, and both the first transistor M1 and the second transistor M2 are switched on. Phase 1: a data line voltage Vdata is written into the first node NodeD through the first transistor M1, the first switch Sw_Ref is closed, and the low level reference voltage input by the DAC circuit is written into the second electrode of the third transistor M3 through the second transistor M2. Phase 2: the third transistor M3 is switched on, the voltage of the first node NodeD is Vdata, and the second electrode of the third transistor M3 is constantly charged to Vdata−Vth; Phase 3: a second node NodeS is charged to the voltage Vdata−Vth of the second electrode of the third transistor M3 through the second transistor M2; Phase 4: the second switch Sw_Samp is closed, the voltage of the second node NodeS is output to an external circuit through the ADC circuit, and then the external circuit compensates the extracted Vth information to the data line signal through an algorithm, so as to complete the threshold voltage compensation.

For the (n+1)th pixel circuit, similar operations are performed in a next blanking region. For example, the control signal GateA (referring to GateA(n+1) in FIG. 1*b*) and the control signal GateB (referring to GateB(n+1) in FIG. 1*b*) are in a high level, and the first transistor M1 and the second transistor M2 are switched on. Phase 1: the data line voltage Vdata is written into the first node NodeD through the first transistor M1, the first switch Sw_Ref is closed, and the low level reference voltage input by the DAC circuit is written into the second electrode of the third transistor M3 through the second transistor M2. Phase 2: the third transistor M3 is switched on, the voltage of the first node NodeD is Vdata, and the second electrode of the third transistor M3 is constantly charged to Vdata−Vth; Phase 3: the second node NodeS is charged to the voltage Vdata−Vth of the second electrode of the third transistor M3 through the second transistor M2; Phase 4: the second switch Sw_Samp is closed, the voltage of the second node NodeS is output to the external circuit through the ADC circuit, and then the external circuit compensates the extracted Vth information to the data line signal through the algorithm, so as to complete the threshold voltage compensation.

Figure 1C:
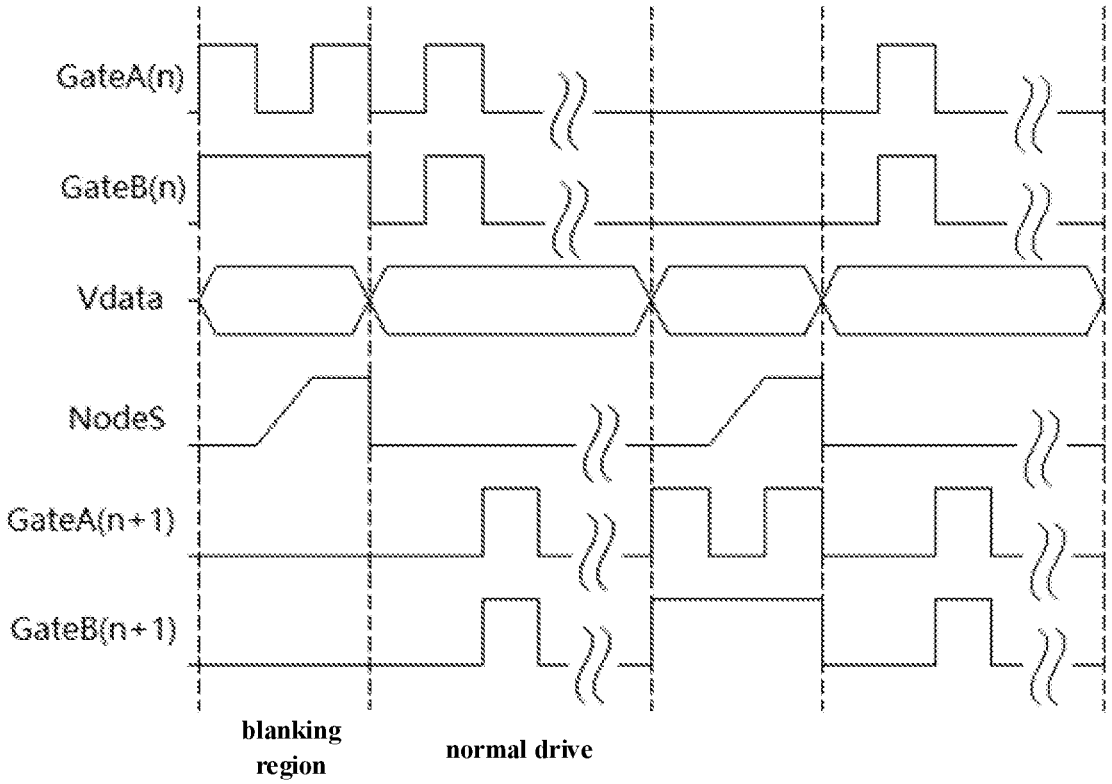
FIG. 1*c* is a schematic diagram showing a drive timing of the OLED pixel circuit in the related technologies during K-value sensing.

FIG. 1*c* is a schematic diagram showing a drive timing of the OLED pixel circuit in the related technologies during K-value sensing (K sensing).

The process of the K-value sensing and a K-value compensation in the related technologies is briefly introduced below in combination with FIG. 1*a* and FIG. 1*c*.

The OLED pixel circuit in the related technologies completes the normal drive of the OLED in the normal driving phase, and realizes carrier mobility μn compensation in the blanking region (Blanking) phase. For the nth pixel circuit, the operations performed in the blanking region are as follows. Phase 1: the control signal GateA (referring to GateA(n) in FIG. 1*c*) and the control signal GateB (referring to GateB(n) in FIG. 1*c*) are in a high level, and the first transistor M1 and the second transistor M2 are switched on; the data line voltage Vdata is written into the first node NodeD through the first transistor M1, the first switch Sw_Ref is closed, and the low level reference voltage input by the DAC circuit is written into the second electrode of the third transistor M3 through the second transistor M2. Phase 2: the control signal GateA (referring to GateA(n) in FIG. 1*c*) is in a low level and the control signal GateB (referring to GateB(n) in FIG. 1*c*) is in a high level, the first transistor M1 is switched off and the second transistor M2 is switched on; both ends of the storage capacitor C1 are floating after the completion of the charging, the third transistor M3 is switched on, the second electrode of the third transistor M3 is charged to Vdata, and the voltage of the first node NodeD is coupled to the voltage Vdata+Vth; Phase 3: the control signal GateA (referring to GateA(n) in FIG. 1*c*) is in a low level and the control signal GateB (referring to GateB(n) in FIG. 1*c*) is in a high level, the first transistor M1 is switched off and the second transistor M2 is switched on, and the second node NodeS is charged to the voltage Vdata of the second electrode of the third transistor M3 through the second transistor M2. Phase 4: the control signal GateA (referring to GateA(n) in FIG. 1*c*) and the control signal GateB (referring to GateB(n) in FIG. 1*c*) are in a high level, the first transistor M1 and the second transistor M2 are switched on, the second switch Sw_Samp is closed, the voltage of the second node NodeS is output to the external circuit through the ADC circuit, and then the external circuit compensates the extracted mobility information to the data line signal through an algorithm, so as to complete the K-value compensation.

For the (n+1)th pixel circuit, similar operations are performed in a next blanking phase. Phase 1: the control signal GateA (referring to GateA(n+1) in FIG. 1*c*) and the control signal GateB (referring to GateB(n+1) in FIG. 1*c*) are in a high level, and the first transistor M1 and the second transistor M2 are switched on, the data line voltage Vdata is written into the first node NodeD through the first transistor M1, the first switch Sw_Ref is closed, and the low level reference voltage input by the DAC circuit is written into the second electrode of the third transistor M3 through the second transistor M2. Phase 2: the control signal GateA (referring to GateA(n+1) in FIG. 1*c*) is in a low level and the control signal GateB (referring to GateB(n+1) in FIG. 1*c*) is in a high level, the first transistor M1 is switched off and the second transistor M2 is switched on; both ends of the storage capacitor C1 are floating after the completion of the charging, the third transistor M3 is switched on, the second electrode of the third transistor M3 is charged to Vdata, and the voltage of the first node NodeD is coupled to the voltage Vdata+Vth. Phase 3: the control signal GateA (referring to GateA(n+1) in FIG. 1*c*) is in a low level and the control signal GateB (referring to GateB(n+1) in FIG. 1*c*) is in a high level, the first transistor M1 is switched off and the second transistor M2 is switched on, and the second node NodeS is charged to the voltage Vdata of the second electrode of the third transistor M3 through the second transistor M2. Phase 4: the control signal GateA (referring to GateA(n+1) in FIG. 1*c*) and the control signal GateB (referring to GateB(n+1) in FIG. 1*c*) are in a high level, the first transistor M1 and the second transistor M2 are switched on, the second switch Sw_Samp is closed, the voltage of the second node NodeS is output to the external circuit through the ADC circuit, and then the external circuit compensates the extracted mobility information to the data line signal through the algorithm, so as to complete the K-value compensation.

As can be seen from the above description, in the related technologies, the drive signal of OLED display device comprises two control signals GateA and GateB, wherein a normal scanning drive is carried out in a scanning (Scan) interval, and a threshold voltage (Vth) compensation and a K-value compensation are carried out in the blanking (V-blanking) interval. Generally when using the GOA (Gate Driver On Array) technology, a period and a waveform of the clock signal (CLK) shall be repeated in a constant form. However, as shown in FIGS. 1*b* and 1*c*, since the waveform and the period in the Scan interval and the V-blanking interval are not constant, it is comparatively difficult to implement with the GOA technology. Therefore, real-time compensation using the GOA circuit will cause a problem.

Figure 2:
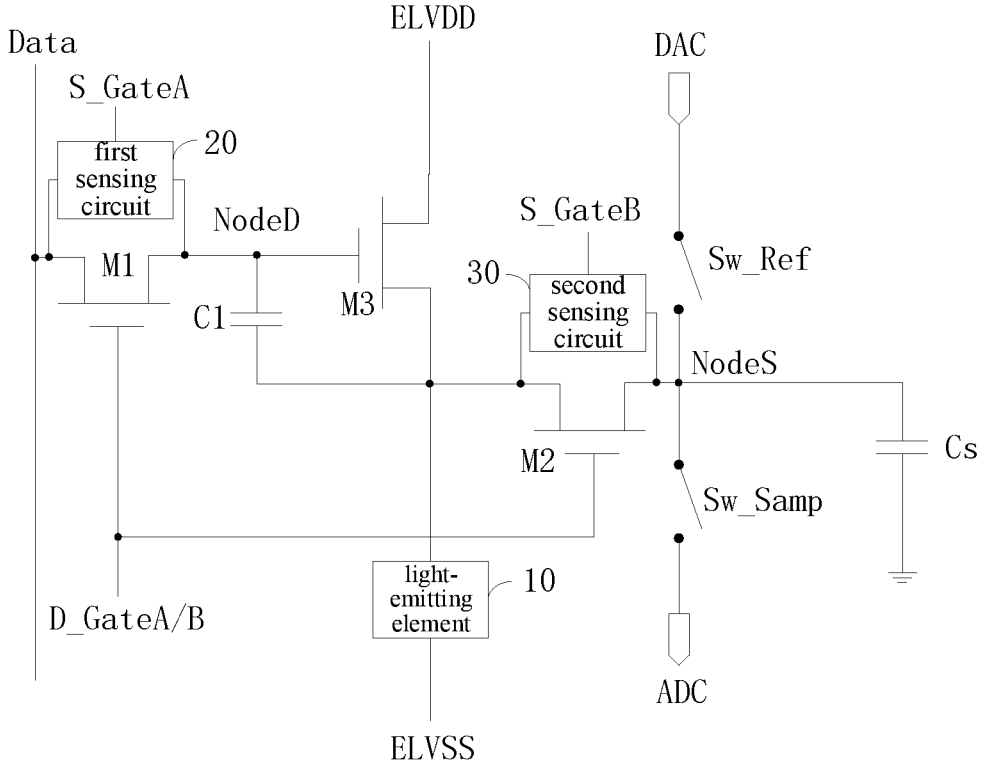
FIG. 2 is a schematic diagram showing a structure of an embodiment of a pixel circuit provided by this disclosure.

A first aspect of the embodiments of this disclosure provides an embodiment of a pixel circuit, which can utilize the GOA circuit for compensation in real time. FIG. 2 is a schematic diagram showing a structure of an embodiment of a pixel circuit provided by this disclosure.

The pixel circuit comprises a first transistor M1, a second transistor M2, a third transistor M3, a storage capacitor C1 and a light-emitting element 10. A control electrode of the first transistor M1 is connected to a first scanning line D_GateA, and first and second electrodes of the first transistor M1 are respectively connected to a data line Data and the third transistor M3's control electrode. A control electrode of the second transistor M2 is connected to a second scanning line D_GateB, first and second electrodes of the second transistor M2 are respectively connected to a second electrode of the third transistor M3 and a sensing line. A first end of the sensing line is connected to a DAC circuit via a first switch Sw_Ref for inputting a reference voltage, and a second end of the sensing line is connected to an ADC circuit via a second switch Sw_Samp for acquiring corresponding electrical parameters to complete parameter compensation. A first electrode of the third transistor M3 is connected to a first power supply terminal ELVDD, first and second ends of the storage capacitor C1 are respectively connected to the control electrode of the third transistor M3 and the first electrode of the second transistor M2. First and second electrodes of the light-emitting element 10 are respectively connected to the second electrode of the third transistor M3 and a second power supply terminal ELVSS, and the sensing line is connected in parallel with a sensing line capacitor Cs.

The pixel circuit further comprises a first sensing circuit 20 and a second sensing circuit 30, wherein the first sensing circuit 20 is connected in parallel with the first transistor M1, and the second sensing circuit 30 is connected in parallel with the second transistor M2. A first sensing signal S_GateA and a second sensing signal S_GateB are respectively input to the first sensing circuit 20 and the second sensing circuit 30 for completing acquisition of electrical parameters of the pixel circuit according to the first sensing signal S_GateA and the second sensing signal S_GateB.

As can be seen from the above embodiments, in the pixel circuit provided by the embodiment of this disclosure, by adding the first sensing circuit and the second sensing circuit, wherein the first sensing circuit is connected in parallel with the first transistor, and the second sensing circuit is connected in parallel with the second transistor, the first transistor and the second transistor in the driving circuit of the pixel circuit can complete the normal drive, while the first sensing circuit and the second sensing circuit complete the acquisition of the electrical parameters of sub-pixels, thereby carrying out parameter compensation. In this way, the drive and compensation of the sub-pixels can be carried out independently, so that respective GOA CLK of the first and second transistors in the driving phase and the first and second sensing circuits in the compensation phase can be made periodic, the Gate signal is generated with GOA as far as possible, and even an image with a desired brightness is displayed in real-time, independent of Vth and K states of the driving transistors of the sub-pixels.

Figure 3:
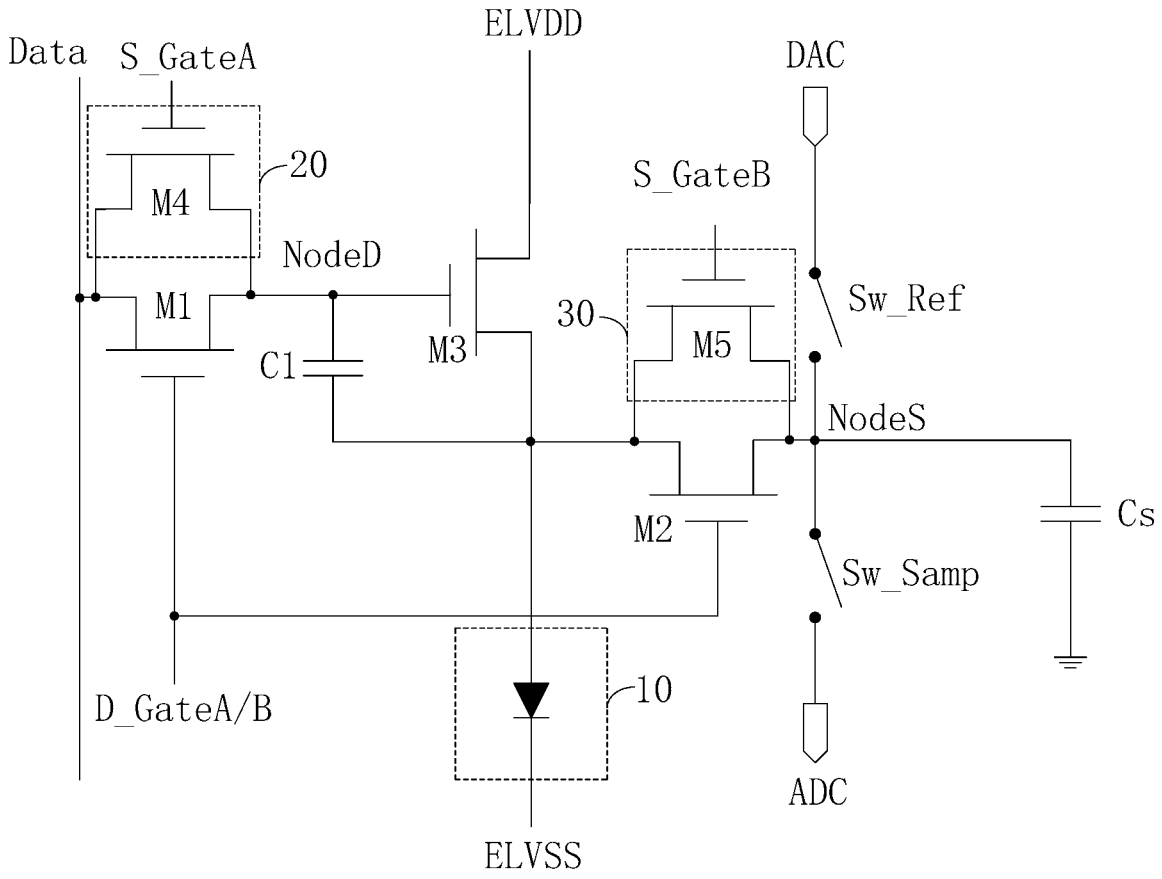
FIG. 3 is a schematic diagram showing a structure of another embodiment of the pixel circuit provided by this disclosure.

The embodiments of this disclosure further provide another embodiment of a pixel circuit, which can utilize the GOA circuit for compensation in real time. FIG. 3 is a schematic diagram showing a structure of another embodiment of the pixel circuit provided by this disclosure.

The pixel circuit comprises a first transistor M1, a second transistor M2, a third transistor M3, a storage capacitor C1 and a light-emitting element 10. A control electrode of the first transistor M1 is connected to a first scanning line D_GateA, first and second electrodes of the first transistor M1 are respectively connected to a data line Data and the third transistor M3's control electrode. A control electrode of the second transistor M2 is connected to a second scanning line D_GateB, first and second electrodes of the second transistor M2 are respectively connected to a second electrode of the third transistor M3 and a sensing line. A first end of the sensing line is connected to a DAC (Digital to Analog Conversion) circuit via a first switch Sw_Ref for inputting a reference voltage, and a second end of the sensing line is connected to an ADC (Analog to Digital Conversion) circuit via a second switch Sw_Samp for acquiring corresponding electrical parameters to complete parameter compensation. A first electrode of the third transistor M3 is connected to a first power supply terminal ELVDD, first and second ends of the storage capacitor C1 are respectively connected to the control electrode of the third transistor M3 and the first electrode of the second transistor M2. First and second electrodes of the light-emitting element 10 are respectively connected to the second electrode of the third transistor M3 and a second power supply terminal ELVSS, and the sensing line is connected in parallel with a sensing line capacitor Cs.

The pixel circuit further comprises a first sensing circuit 20 and a second sensing circuit 30, wherein the first sensing circuit 20 is connected in parallel with the first transistor M1, and the second sensing circuit 30 is connected in parallel with the second transistor M2. A first sensing signal S_GateA and a second sensing signal S_GateB are respectively input to the first sensing circuit 20 and the second sensing circuit 30 for completing acquisition of the electrical parameters of the pixel circuit according to the first sensing signal S_GateA and the second sensing signal S_GateB.

As shown in FIG. 3, the first sensing circuit 20 comprises a fourth transistor M4. A first sensing signal S_GateA is input to a control electrode of the fourth transistor M4, and first and second electrodes of the fourth transistor M4 are respectively connected to the data line Data and the control electrode of the third transistor M3. In this way, by using the fourth transistor M4 for implementing the first sensing circuit 20, on the one hand, the acquisition of the electrical parameters of the pixel circuit can be completed, and on the other hand, the circuit structure is simple and the process can be simplified.

As shown in FIG. 3, the second sensing circuit 30 comprises a fifth transistor M5. A second sensing signal S_GateB is input to a control electrode of the fifth transistor M5, and first and second electrodes of the fifth transistor M5 are respectively connected to the second electrode of the third transistor M3 and the sensing line. In this way, by using the fifth transistor M5 for implementing the second sensing circuit 30, on the one hand, the acquisition of the electrical parameters of the pixel circuit can be completed, and on the other hand, the circuit structure is simple and the process can be simplified.

As can be seen from the above embodiments, in the pixel circuit provided by the embodiment of this disclosure, by adding the first sensing circuit and the second sensing circuit, wherein the first sensing circuit is connected in parallel with the first transistor, and the second sensing circuit is connected in parallel with the second transistor, the first transistor and the second transistor in the driving circuit of the pixel circuit can complete the normal drive, while the first sensing circuit and the second sensing circuit complete the acquisition of the electrical parameters of sub-pixels, thereby carrying out parameter compensation. In this way, the drive and compensation of the sub-pixels can be carried out independently, so that respective GOA CLK of the first and second transistors in the driving phase and the first and second sensing circuits in the compensation phase can be made periodic, the Gate signal is generated with GOA as far as possible, and even an image with a desired brightness is displayed in real-time, independent of Vth and K states of the driving transistors of the sub-pixels.

In addition, it should be noted that, although the embodiments of this disclosure only show examples in which transistors are utilized for implementing the sensing circuits, those skilled in the art would understand that devices or circuits other than the transistors can be utilized for implementing the sensing circuits.

Figure 5A:
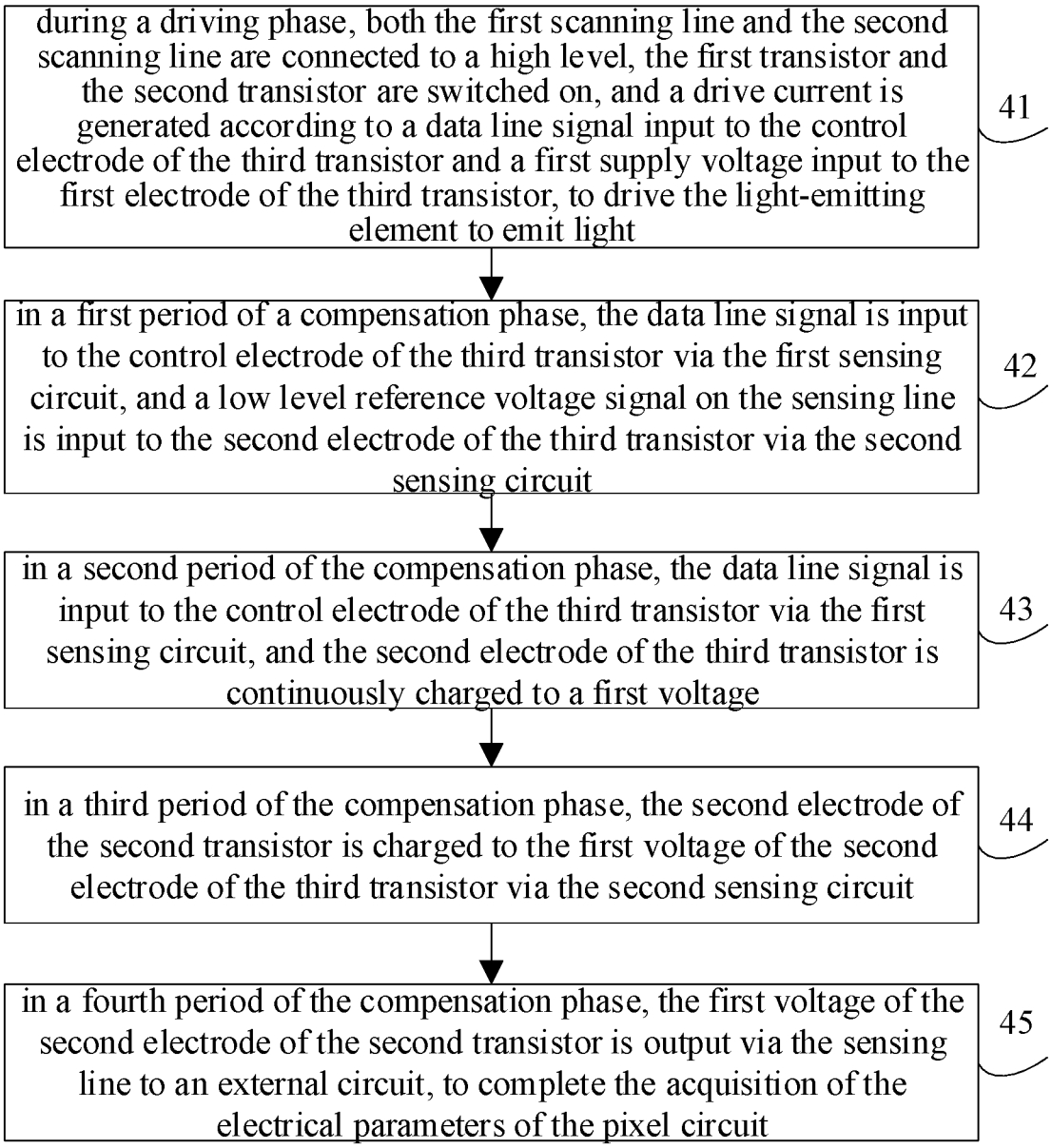
FIG. 5*a* is a schematic diagram showing an embodiment of a control method for the pixel circuit provided by this disclosure.
Figure 5B:
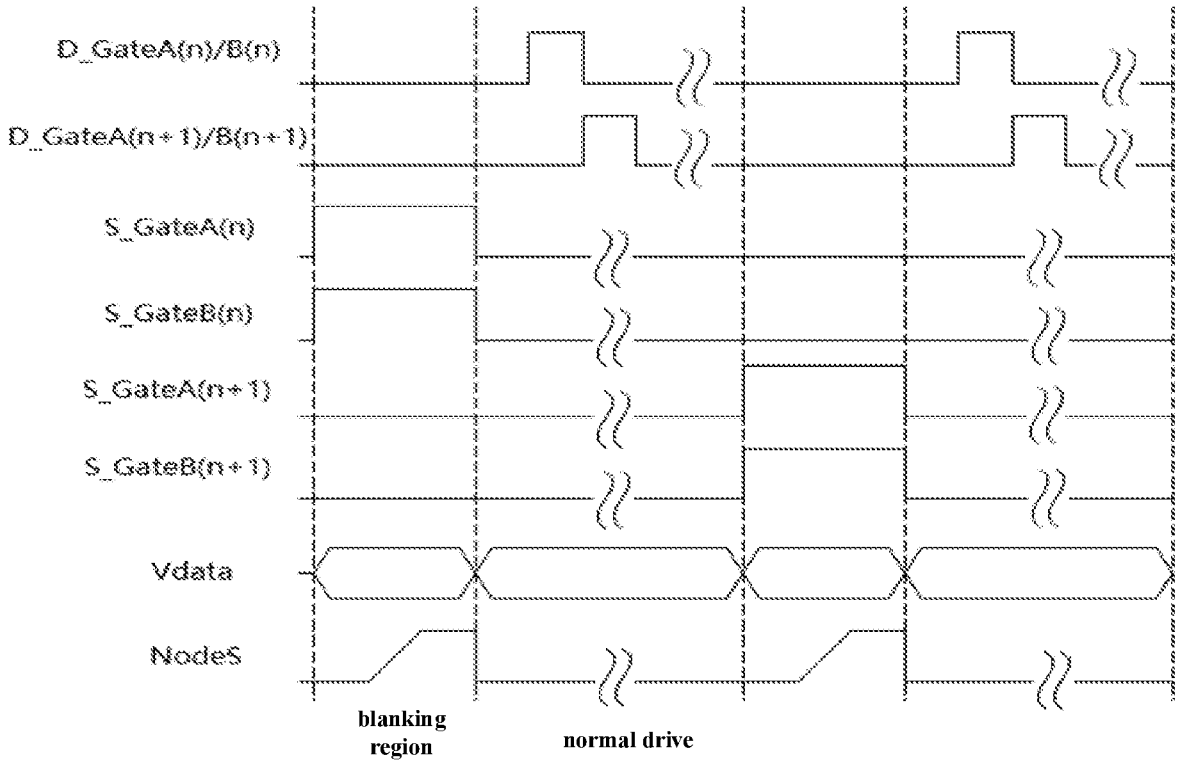
FIG. 5*b* is a schematic diagram showing a drive timing of an embodiment of a pixel circuit provided by this disclosure during the threshold voltage sensing.
Figure 6A:
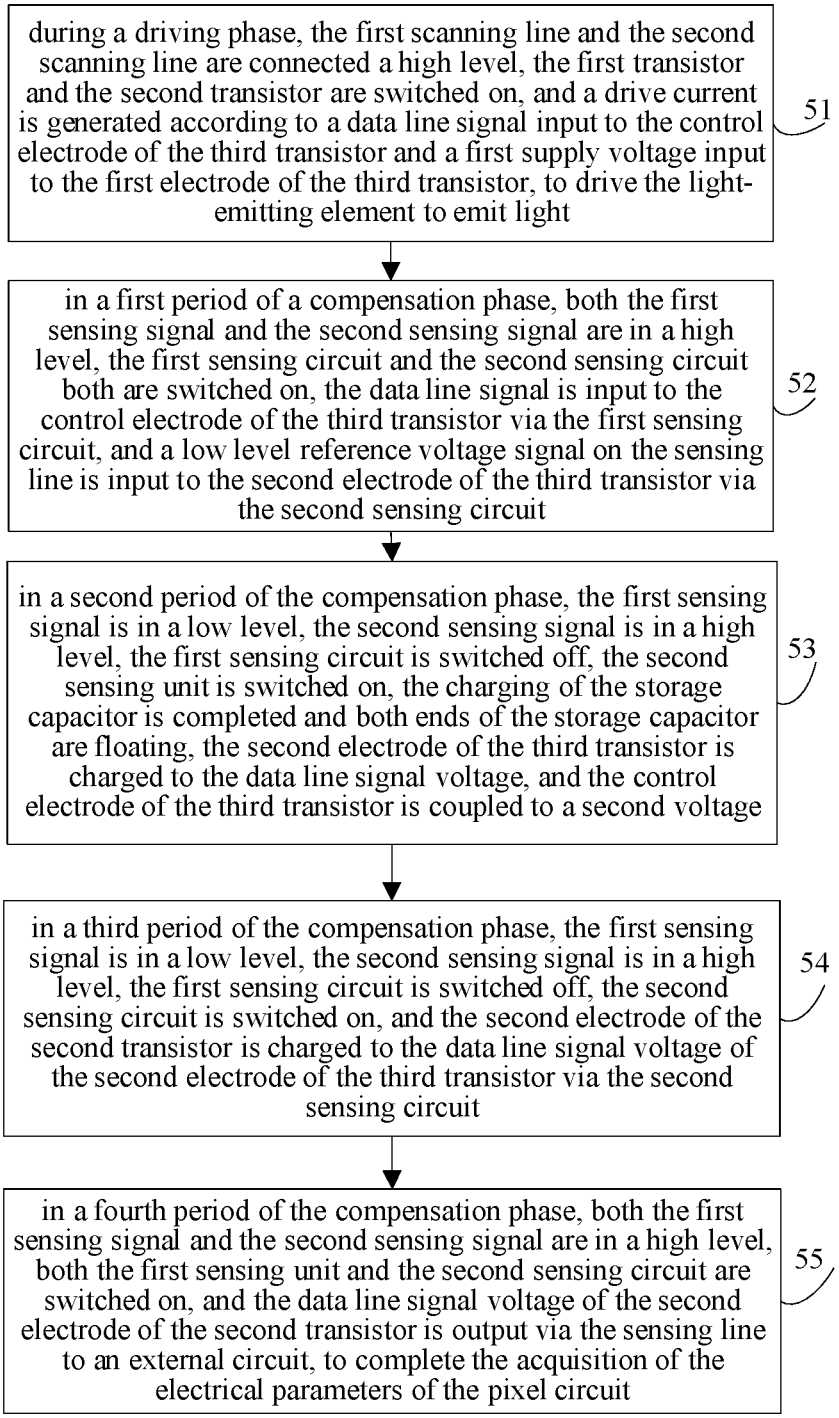
FIG. 6*a* is a schematic diagram showing another embodiment of a control method for the pixel circuit provided by this disclosure.
Figure 6B:
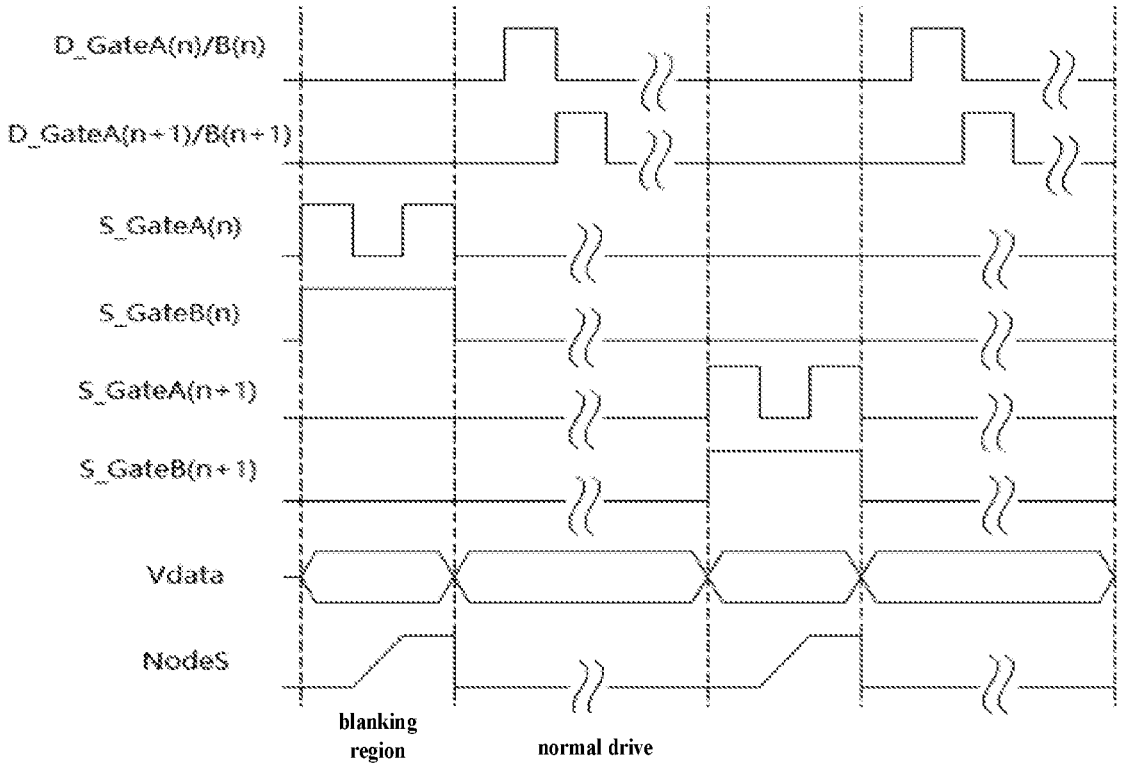
FIG. 6*b* is a schematic diagram showing a drive timing of an embodiment of a pixel circuit provided by this disclosure during the K-value sensing.

In one example, with reference to FIG. 5*b* and FIG. 6*b*, same drive signals are input to the first scanning line D_GateA and the second scanning line D_GateB. In this way, same drive signals are input to the first scanning line D_GateA and the second scanning line D_GateB, which can simplify the design of the circuit structure and the design of the drive timing, thus simplifying the process. In one example, the third transistor M3 is a driving transistor for driving the light-emitting element. In one example, the light-emitting element 10 is an organic light-emitting diode OLED.

It should be noted that the transistors in the aforementioned embodiments are independently selected from one of polysilicon thin film transistors, amorphous silicon thin film transistors, oxide thin film transistors and organic thin film transistors. The "control electrode" involved in this embodiment can specifically refer to a gate electrode or a base electrode of the transistor, and the "first electrode" can specifically refer to a source electrode or a emitter electrode of the transistor, and the corresponding "second electrode" can specifically refer to a drain electrode or a collector electrode of the transistor. Of course, those skilled in the art would know that the "first electrode" and "second electrode" can be interchanged.

In addition, the first transistor M1, the second transistor M2, the third transistor M3, the fourth transistor M4 and the fifth transistor M5 in the above embodiments all are N-type transistors, which is merely an exemplary solution that is easy to implement in this embodiment and will not limit the technical solution of this disclosure. Those skilled in the art shall know that, simple changes to the type of each transistor (N type or P type), as well as changes to positive and negative polarities of the output voltages of each power supply terminal and each control signal line, so as to achieve the same on or off operation performed on each transistor in the embodiment, all fall within the scope of protection of this application. Examples are not listed one by one here for details.

The transistors used in all embodiments of this disclosure may be thin film transistors or field effect transistors or other devices with same characteristics. In the embodiments of this disclosure, in order to make a distinction between two electrodes except the gate electrode of the transistor, one is called the source electrode, and the other is called the drain electrode. In addition, the transistors can be divided into N-type transistors or P-type transistors according to the characteristics of the transistors. In the drive circuit provided by the embodiment of this disclosure, all transistors are illustrated by the N-type transistor as an example, but it is easy for those skilled in the art to think of using P-type transistors for the implementation without paying out any creative effort, and therefore it is also within the scope of protection of the embodiment of this disclosure.

In the embodiment of this disclosure, for the N-type transistors, the first electrode is a source electrode and the second electrode is a drain electrode, and for the P-type transistors, the first electrode is a drain electrode and the second electrode is a source electrode.

Figure 4A:
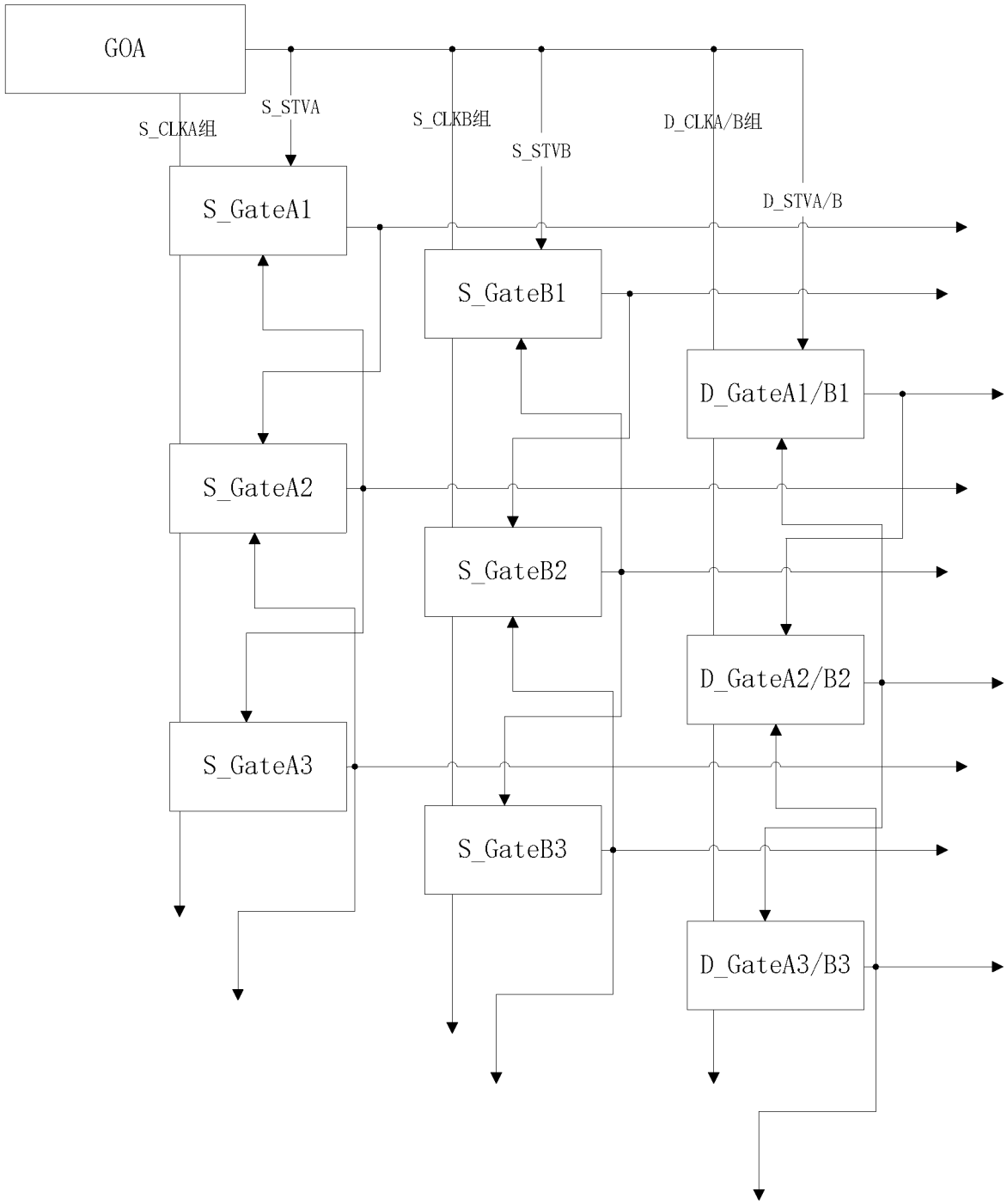
FIG. 4*a* is a schematic block diagram showing a structure of an embodiment of a pixel circuit provided by this disclosure under the control of GOA drive.
Figure 4B:
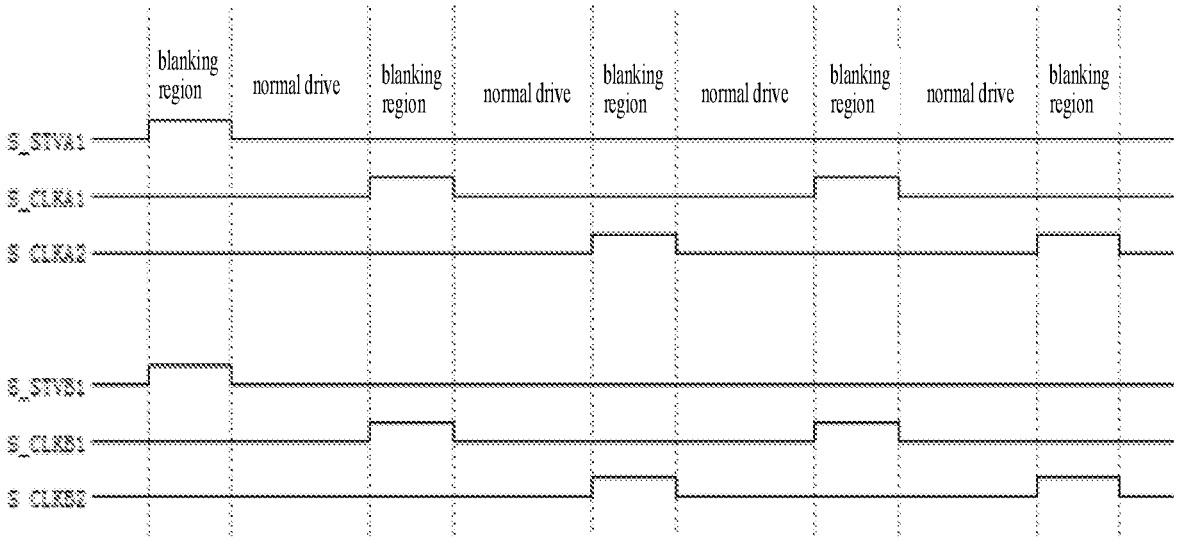
FIG. 4*b* is a schematic diagram showing a drive timing of a control signal of an embodiment of a pixel circuit provided by this disclosure during the threshold voltage sensing and compensation.
Figure 4C:
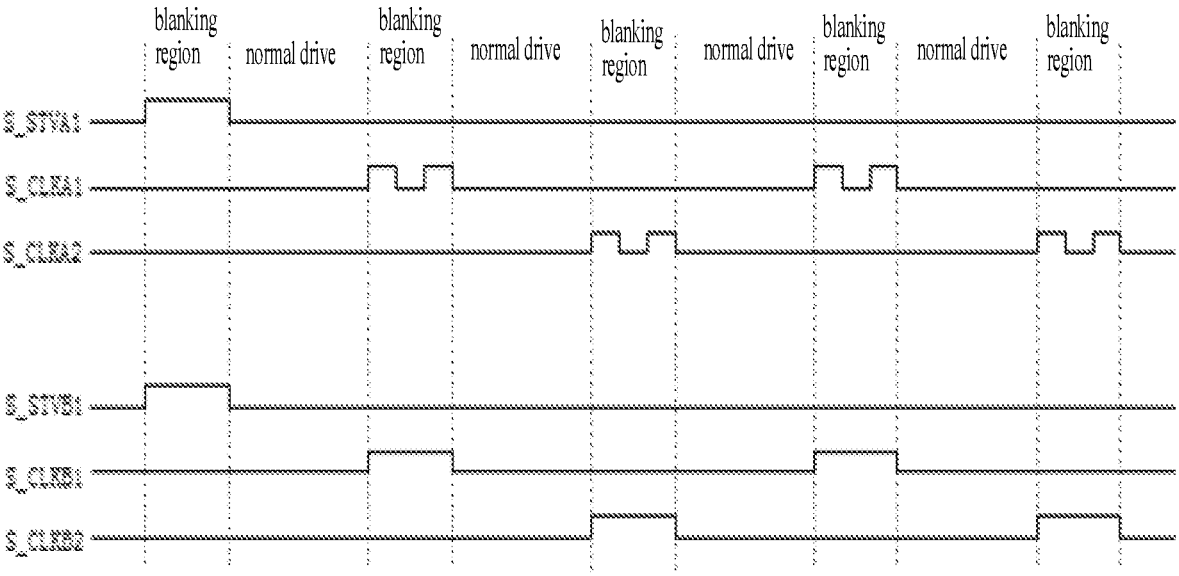
FIG. 4*c* is a schematic diagram showing a drive timing of a control signal of an embodiment of a pixel circuit provided by this disclosure during the K-value sensing and compensation.

FIG. 4*a* is a schematic block diagram showing a structure of the embodiment of the pixel circuit provided by this disclosure under the control of GOA drive. As can be seen from FIG. 4*a*, different control signals generated by the GOA circuit, namely, S_CLKA group and S_STVA, S_CLKB group and S_STVB, D_CLKA/B group and D_STVA/B, are respectively used for driving the modules S_GateA(n), S_GateB(n), D_GateA(n)/B(n), such that they output respective sensing signals or scanning signals; wherein, FIG. 4*b* shows drive timings of the control signals S_CLKA group and S_STVA, S_CLKB group and S_STVB during threshold voltage sensing and compensation, and FIG. 4*c* shows drive timings of the control signals S_CLKA group and S_STVA, S_CLKB group and S_STVB during K-value sensing and compensation. As can be seen from FIGS. 4*a*-4*c*, the clock control signals in the sensing and compensation phases of each pixel circuit can independently complete the sensing drive respectively, so as to utilize the GOA circuit for real-time compensation.

A second aspect of the embodiments of this disclosure provides an embodiment of a method for controlling the pixel circuit, which can utilize the GOA circuit for real-time compensation. FIG. 5*a* is a schematic diagram showing an embodiment of the method for controlling the pixel circuit provided by this disclosure.

In combination with FIG. 2 and with reference to FIG. 5*b*, the method for controlling any embodiment of the pixel circuit comprises the following steps.

Step 41: during a driving phase, the first scanning line D_GateA and the second scanning line D_GateB are connected to a high level, thereby the first transistor M1 and the second transistor M2 are switched on, and a drive current is generated according to a data line signal Vdata input to the control electrode of the third transistor M3 and a first supply voltage ELVDD input to the first electrode of the third transistor M3, to drive the light-emitting element 10 to emit light.

During a compensation phase, both the first sensing signal S_GateA and the second sensing signal S_GateB are in a high level, thereby both the first sensing circuit 20 and the second sensing circuit 30 are switched on. The compensation phase comprises the following steps.

Step 42: in a first period of the compensation phase, the data line signal Vdata is input to the control electrode of the third transistor M3 via the first sensing circuit 20, and a low level reference voltage signal on the sensing line is input to the second electrode of the third transistor M3 via the second sensing circuit 30.

Step 43: in a second period of the compensation phase, the data line signal Vdata is input to the control electrode of the third transistor M3 via the first sensing circuit 20, and the second electrode of the third transistor M3 is continuously charged to a first voltage.

Step 44: in a third period of the compensation phase, the second electrode of the second transistor M2 is charged to the first voltage of the second electrode of the third transistor M3 through the second sensing circuit 30.

Step 45: in a fourth period of the compensation phase, the first voltage of the second electrode of the second transistor M2 is output via the sensing line to an external circuit to complete the acquisition of the electrical parameters of the pixel circuit, such that the external circuit can compensate the Vth information extracted from the electrical parameters to the data line signal through an algorithm.

As can be seen from the aforementioned embodiments, the method for controlling the pixel circuit provided by the embodiment of this disclosure, by designing a corresponding control method for the pixel circuit, can complete driving control and parameter compensation.

In one example, with reference to FIG. 5*b*, a control timing of the pixel circuit includes a normal drive timing and a blanking region of the pixel circuit, and the driving phase is in the normal drive timing in the control timing of the pixel circuit, and the compensation phase is in the blanking region in the control timing of the pixel circuit. In this way, completing compensation in the blanking region will not affect normal driving of the light-emitting element 10; in one example, the light-emitting element 10 is an organic light-emitting diode OLED.

In one example, the method is applied to the threshold voltage compensation, and the first voltage is the data line signal voltage minus the threshold voltage of the third transistor, i.e., Vdata−Vth.

In one example, as shown in FIG. 3, the first sensing circuit 20 comprises a fourth transistor M4, wherein the first sensing signal S_GateA is input to a control electrode of the fourth transistor M4, and first and second electrodes of the fourth transistor M4 are respectively connected to the data line Data and the third transistor M3's control electrode. In this way, by utilizing the fourth transistor M4 for implementing the first sensing circuit 20, on the one hand, acquisition of the electrical parameters of the pixel circuit can be completed, and on the other hand, the circuit structure is simple and the process is simplified.

The second sensing circuit 30 comprises a fifth transistor M5. the second sensing signal S_GateB is input to a control electrode of the fifth transistor M5, and first and second electrodes of the fifth transistor M5 are respectively connected to the second electrode of the third transistor M3 and the sensing line. In this way, by utilizing the fifth transistor M5 for implementing the second sensing circuit 30, on the one hand, acquisition of the electrical parameters of the pixel circuit can be completed, and on the other hand, the circuit structure is simple and the process is simplified.

A third aspect of the embodiments of this disclosure provides an embodiment of a method for controlling the pixel circuit, which can utilize the GOA circuit for real-time compensation. FIG. 6*a* is a schematic diagram showing another embodiment of the method for controlling the pixel circuit provided by this disclosure.

In combination with FIG. 2 and with reference to FIG. 6*b*, the method for controlling any embodiment of the pixel circuit comprises the following steps.

Step 51: during a driving phase, the first scanning line D_GateA and the second scanning line D_GateB are connected to a high level, thereby the first transistor M1 and the second transistor M2 are switched on, and a drive current is generated according to a data line signal Vdata input to the control electrode of the third transistor M3 and a first supply voltage ELVDD input to the first electrode of the third transistor M3, to drive the light-emitting element 10 to emit light.

Step 52: in a first period of a compensation phase, both the first sensing signal S_GateA and the second sensing signal S_GateB are in a high level, thereby both the first sensing circuit 20 and the second sensing circuit 30 are switched on, the data line signal Vdata is input to the control electrode of the third transistor M3 via the first sensing circuit 20, and a low level reference voltage signal on the sensing line is input to the second electrode of the third transistor M3 via the second sensing circuit 30.

Step 53: in a second period of the compensation phase, the first sensing signal S_GateA is in a low level, the second sensing signal S_GateB is in a high level, the first sensing circuit 20 is switched off, the second sensing circuit 30 is switched on, the charging of the storage capacitor C1 is completed and both ends of the storage capacitor are floating, the second electrode of the third transistor M3 is charged to the data line signal voltage Vdata, and the control electrode of the third transistor M3 is coupled to the second voltage.

Step 54: in a third period of the compensation phase, the first sensing signal S_GateA is in a low level, the second sensing signal S_GateB is in a high level, the first sensing circuit 20 is switched off, the second sensing circuit 30 is switched on, and the second electrode of the second transistor M2 is charged to the data line signal voltage Vdata of the second electrode of the third transistor M3 through the second sensing circuit 30.

Step 55: in a fourth period of the compensation phase, both the first sensing signal S_GateA and the second sensing signal S_GateB are in a high level, both the first sensing circuit 20 and the second sensing circuit 30 are switched on, and the data line signal voltage Vdata of the second electrode of the second transistor M2 is output via the sensing line to an external circuit to complete the acquisition of the electrical parameters of the pixel circuit.

As can be seen from the aforementioned embodiments, the method for controlling the pixel circuit provided by the embodiment of this disclosure, by designing a corresponding control method for the pixel circuit, can complete driving control and parameter compensation.

In one example, with reference to FIG. 6*b*, the control timing of the pixel circuit includes a normal drive timing and a blanking region of the pixel circuit, and the driving phase is in the normal drive timing in the control timing of the pixel circuit, and the compensation phase is in the blanking region in the control timing of the pixel circuit. In this way, completing compensation in the blanking region will not affect normal driving of the light-emitting element 10; in one example, the light-emitting element 10 is an organic light-emitting diode OLED.

In one example, the method is applied to carrier mobility compensation, and the second voltage is the data line signal voltage plus the threshold voltage of the third transistor, i.e., Vdata+Vth.

In one example, the first sensing circuit 20 comprises a fourth transistor M4, wherein the first sensing signal S_GateA is input to a control electrode of the fourth transistor M4, and first and second electrodes of the fourth transistor M4 are respectively connected to the data line Data and the third transistor M3's control electrode. In this way, by utilizing the fourth transistor M4 for implementing the first sensing circuit 20, on the one hand, acquisition of the electrical parameters of the pixel circuit can be completed, and on the other hand, the circuit structure is simple and the process is simplified.

The second sensing circuit 30 comprises a fifth transistor M5, the second sensing signal S_GateB is input to a control electrode of the fifth transistor M5, and first and second electrodes of the fifth transistor M5 are respectively connected to the second electrode of the third transistor M3 and the sensing line. In this way, by utilizing the fifth transistor M5 for implementing the second sensing circuit 30, on the one hand, acquisition of the electrical parameters of the pixel circuit can be completed, and on the other hand, the circuit structure is simple and the process is simplified.

A fourth aspect of the embodiments of this disclosure provides an embodiment of a display substrate, which can utilize the GOA circuit for real-time compensation.

The display substrate comprises any embodiment of the pixel circuit as recited above.

As can be seen from the above embodiments, in the display substrate provided by the embodiment of this disclosure, by adding the first sensing circuit and the second sensing circuit to the pixel circuit, wherein the first sensing circuit is connected in parallel with the first transistor, and the second sensing circuit is connected in parallel with the second transistor, the first transistor and the second transistor in the driving circuit of the pixel circuit can complete the normal drive, while the first sensing circuit and the second sensing circuit complete the acquisition of the electrical parameters of sub-pixels, thereby carrying out parameter compensation. In this way, the drive and compensation of the sub-pixels can be carried out independently, so that respective GOA CLK of the first and second transistors in the driving phase and the first and second sensing circuits in the compensation phase can be made periodic, the Gate signal is generated with GOA as far as possible, and even an image with a desired brightness is displayed in real-time, independent of Vth and K states of the driving transistors of the sub-pixels.

A fifth aspect of the embodiments of this disclosure provides an embodiment of a display device, which can utilize the GOA circuit for real-time compensation.

The display device comprises the display substrate as recited above.

It should be noted that, the display device in the embodiment may be any product or component with display capabilities, such as electronic paper, mobile phones, tablets, televisions, laptops, digital photo frames, and navigators.

As can be seen from the above embodiments, in the display device provided by the embodiment of this disclosure, by adding the first sensing circuit and the second sensing circuit to the pixel circuit, wherein the first sensing circuit is connected in parallel with the first transistor, and the second sensing circuit is connected in parallel with the second transistor, the first transistor and the second transistor in the driving circuit of the pixel circuit can complete the normal drive, while the first sensing circuit and the second sensing circuit complete the acquisition of the electrical parameters of sub-pixels, thereby carrying out parameter compensation. In this way, the drive and compensation of the sub-pixels can be carried out independently, so that respective GOA CLK of the first and second transistors in the driving phase and the first and second sensing circuits in the compensation phase can be made periodic, the Gate signal is generated with GOA as far as possible, and even an image with a desired brightness is displayed in real-time, independent of Vth and K states of the driving transistors of the sub-pixels.

In this disclosure, the terms "first", "second", "third" and "fourth" are used only for descriptive purposes and cannot be construed as indicating or implying relative importance. The term "a plurality of" refers to two or more, unless otherwise expressly defined.

Those skilled in the art would appreciate that the above embodiments are only specific embodiments of this disclosure and are not intended to restrict this disclosure, and any modifications, equivalent substitutions, improvements, etc. made within the spirit and principle of this disclosure shall fall within the scope of protection of this disclosure.

What is claimed is:

1. A method for controlling a pixel circuit, the pixel circuit comprising: a first transistor, a second transistor, a third transistor, a storage capacitor and a light-emitting element; wherein a control electrode of the first transistor is connected to a first scanning line, first and second electrodes of the first transistor are respectively connected to a data line and a control electrode of the third transistor, a control electrode of the second transistor is connected to a second scanning line, first and second electrodes of the second transistor are respectively connected to a second electrode of the third transistor and a sensing line, a first electrode of the third transistor is connected to a first power supply terminal, first and second ends of the storage capacitor are respectively connected to the control electrode of the third transistor and the first electrode of the second transistor, and first and second electrodes of the light-emitting element are respectively connected to the second electrode of the third transistor and a second power supply terminal; and a first sensing circuit and a second sensing circuit, wherein the first sensing circuit is connected in parallel with the first transistor, and the second sensing circuit is connected in parallel with the second transistor; a first sensing signal and a second sensing signal are respectively input to the first sensing circuit and the second sensing circuit for completing acquisition of electrical parameters of the pixel circuit according to the first sensing signal and the second sensing signal, the method comprising:

during a driving phase, connecting both the first scanning line and the second scanning line to a high level, thereby the first transistor and the second transistor are switched on, and a drive current is generated according to a data line signal input to the control electrode of the third transistor and a first supply voltage input to the first electrode of the third transistor, to drive the light-emitting element to emit light;

during a compensation phase, setting both the first sensing signal and the second sensing signal to a high level, thereby both the first sensing circuit and the second sensing circuit are switched on, wherein:

in a first period of the compensation phase, the data line signal is input to the control electrode of the third transistor via the first sensing circuit, and a low level reference voltage signal on the sensing line is input to the second electrode of the third transistor via the second sensing circuit;

in a second period of the compensation phase, the data line signal is input to the control electrode of the third transistor via the first sensing circuit, and the second electrode of the third transistor is continuously charged to a first voltage;

in a third period of the compensation phase, the second electrode of the second transistor is charged to the first voltage of the second electrode of the third transistor via the second sensing circuit;

in a fourth period of the compensation phase, the first voltage of the second electrode of the second transistor is output via the sensing line to an external circuit, to complete the acquisition of the electrical parameters of the pixel circuit.

2. The pixel circuit method according to claim 1, wherein the first sensing circuit comprises a fourth transistor, the first sensing signal is input to a control electrode of the fourth transistor, and first and second electrodes of the fourth transistor are respectively connected to the data line and the control electrode of the third transistor.

3. The pixel circuit method according to claim 2, wherein the second sensing circuit comprises a fifth transistor, wherein the second sensing signal is input to a control electrode of the fifth transistor, and first and second electrodes of the fifth transistor are respectively connected to the second electrode of the third transistor and the sensing line.

4. The pixel circuit method according to claim 1, wherein the second sensing circuit comprises a fifth transistor, wherein the second sensing signal is input to a control electrode of the fifth transistor, and first and second electrodes of the fifth transistor are respectively connected to the second electrode of the third transistor and the sensing line.

5. The pixel circuit method according to claim 1, wherein same driving signals are input to the first scanning line and the second scanning line.

6. The pixel circuit method according to claim 1, wherein the third transistor is a driving transistor.

7. The pixel circuit method according to claim 1, wherein the light-emitting element is an organic light-emitting diode.

8. The method according to claim 1, wherein a control timing for controlling the pixel circuit includes a normal drive timing and a blanking region of the pixel circuit, and the driving phase is in the normal drive timing, and the compensation phase is in the blanking region.

9. The method according to claim 1, wherein the method is applied to threshold voltage compensation, and the first voltage is a data line signal voltage minus a threshold voltage of the third transistor.

10. A method for controlling a pixel circuit, the pixel circuit comprising: a first transistor, a second transistor, a third transistor, a storage capacitor and a light-emitting element; wherein a control electrode of the first transistor is connected to a first scanning line, first and second electrodes of the first transistor are respectively connected to a data line and a control electrode of the third transistor, a control electrode of the second transistor is connected to a second scanning line, first and second electrodes of the second transistor are respectively connected to a second electrode of the third transistor and a sensing line, a first electrode of the third transistor is connected to a first power supply terminal, first and second ends of the storage capacitor are respectively connected to the control electrode of the third transistor and the first electrode of the second transistor, and first and second electrodes of the light-emitting element are respectively connected to the second electrode of the third transistor and a second power supply terminal; and a first sensing circuit and a second sensing circuit, wherein the first sensing circuit is connected in parallel with the first transistor, and the second sensing circuit is connected in parallel with the second transistor; a first sensing signal and a second sensing signal are respectively input to the first sensing circuit and the second sensing circuit for completing acquisition of electrical parameters of the pixel circuit according to the first sensing signal and the second sensing signal, the method comprising:

during a driving phase, connecting the first scanning line and the second scanning line to a high level, thereby the first transistor and the second transistor are switched on, and a drive current is generated according to a data line signal input to the control electrode of the third transistor and a first supply voltage input to the first electrode of the third transistor, to drive the light-emitting element to emit light;

in a first period of a compensation phase, setting both the first sensing signal and the second sensing signal to a high level, both the first sensing circuit and the second sensing circuit are switched on, the data line signal is input to the control electrode of the third transistor via the first sensing circuit, and a low level reference voltage signal on the sensing line is input to the second electrode of the third transistor via the second sensing circuit;

in a second period of the compensation phase, setting the first sensing signal to a low level, setting the second sensing signal to a high level, thereby the first sensing circuit is switched off, the second sensing circuit is switched on, the charging of the storage capacitor is completed and both ends of the storage capacitor are floating, the second electrode of the third transistor is charged to a data line signal voltage, and the control electrode of the third transistor is coupled to a second voltage;

in a third period of the compensation phase, setting the first sensing signal to a low level, setting the second sensing signal to a high level, thereby the first sensing circuit is switched off, the second sensing circuit is switched on, and the second electrode of the second transistor is charged to the data line signal voltage of the second electrode of the third transistor via the second sensing circuit;

in a fourth period of the compensation phase, setting both the first sensing signal and the second sensing signal to a high level, thereby both the first sensing circuit and the second sensing circuit are switched on, and the data line signal voltage of the second electrode of the second transistor is output via the sensing line to an external circuit, to complete the acquisition of the electrical parameters of the pixel circuit.

11. The method according to claim 10, wherein a control timing for controlling the pixel circuit includes a normal drive timing and a blanking region of the pixel circuit, and the driving phase is in the normal drive timing, and the compensation phase is in the blanking region.

12. The method according to claim 10, wherein the method is applied to carrier mobility compensation, and the second voltage is the data line signal voltage plus a threshold voltage of the third transistor.

13. The method according to claim 10, wherein the first sensing circuit comprises a fourth transistor, the first sensing signal is input to a control electrode of the fourth transistor, and first and second electrodes of the fourth transistor are respectively connected to the data line and the control electrode of the third transistor.

14. The method according to claim 13, wherein the second sensing circuit comprises a fifth transistor, wherein the second sensing signal is input to a control electrode of the fifth transistor, and first and second electrodes of the fifth transistor are respectively connected to the second electrode of the third transistor and the sensing line.

15. The method according to claim 10, wherein the second sensing circuit comprises a fifth transistor, wherein the second sensing signal is input to a control electrode of the fifth transistor, and first and second electrodes of the fifth transistor are respectively connected to the second electrode of the third transistor and the sensing line.

16. The method according to claim 10, wherein same driving signals are input to the first scanning line and the second scanning line.

17. The method according to claim 10, wherein the third transistor is a driving transistor.

18. The method according to claim 10, wherein the light-emitting element is an organic light-emitting diode.

* * * * *